US010945504B2

(12) United States Patent
LaFauci

(10) Patent No.: US 10,945,504 B2
(45) Date of Patent: Mar. 16, 2021

(54) HAIR CLIP APPARATUS

(71) Applicant: Conair Corporation, Stamford, CT (US)

(72) Inventor: Mariagrazia LaFauci, Upper Black Eddy, PA (US)

(73) Assignee: Conair Corporation, Stamford, CT (US)

( * ) Notice: Subject to any disclaimer, the term of this patent is extended or adjusted under 35 U.S.C. 154(b) by 188 days.

(21) Appl. No.: 16/158,906

(22) Filed: Oct. 12, 2018

(65) Prior Publication Data

US 2020/0113304 A1 Apr. 16, 2020

(51) Int. Cl.
*A45D 8/32* (2006.01)
*A45D 8/10* (2006.01)

(52) U.S. Cl.
CPC . *A45D 8/32* (2013.01); *A45D 8/10* (2013.01)

(58) Field of Classification Search
CPC ... A45D 8/16; A45D 8/10; A45D 8/22; A45D 8/24; A45D 8/26; A45D 8/30; A45D 8/32
USPC ..... 132/279
See application file for complete search history.

(56) References Cited

U.S. PATENT DOCUMENTS 3,861,008 A * 1/1975 Wannag ..... D06F 55/00 24/543
4,011,639 A * 3/1977 Koleske ..... A45D 8/24 24/561
5,775,345 A * 7/1998 Chou ..... A45D 8/14 132/278
6,966,103 B2 * 11/2005 Gould ..... A45D 8/16 24/13
7,373,940 B1 * 5/2008 Lloyd ..... A45D 8/30 132/278
7,665,191 B2 * 2/2010 Gould ..... A45F 5/02 132/276
8,151,808 B2 * 4/2012 Tu ..... A45D 8/14 132/276
2003/0221700 A1 12/2003 La Fauci
2017/0172274 A1 6/2017 Tsai

FOREIGN PATENT DOCUMENTS

JP 3192376 B2 7/2001

* cited by examiner

*Primary Examiner* — Nicholas D Lucchesi
(74) *Attorney, Agent, or Firm* — Lawrence Cruz, Esq.; Ryan, Mason & Lewis, LLP

(57) ABSTRACT

A hair clip apparatus includes a tongue, a clasp and a plurality of hair engaging teeth. The clasp cooperates with the tongue to retain the hair in a desired styling effect. The hair engaging teeth are spaced from the clasp and the tongue to engage hair surrounding the clasp and the tongue. The hair clip apparatus is retained in the volume of hair by trapping the hair between the clasp and the tongue, and also via the hair engaging teeth. The hair engaging teeth also are arranged to retain and secure hair between adjacent teeth, and also trap hair between the inner surfaces of the teeth and the base and/or tongue.

15 Claims, 4 Drawing Sheets

HAIR CLIP APPARATUS

BACKGROUND

1. Technical Field

The present disclosure relates to a hair styling accessory, and, in particular, relates to a hair clip apparatus for retaining hair in a desired orientation. The present disclosure further relates to a hair clip apparatus incorporating structure providing multi-attachment capabilities which facilitate maintenance of the hair in the desired styling effect and also retention of the hair clip apparatus within the volume of hair.

2. Discussion of Related Art

Hair pins, barrettes, and/or hair clips are commonly utilized to retain hair in a desired orientation, e.g., to keep hair bunched together or arranged to achieve a defined style. Although these devices are generally useful for their intended purposes, they are deficient with respect to retaining the hair during activity of the user such as during exercise, swimming etc. In particular, known hair clips tend to release the hair and/or become dislodged from the hair upon movement of the user. Moreover, known hair clips incorporate only a single attachment mechanism for securing the hair in the desired style and for retaining the hair clip within the hair.

SUMMARY

Accordingly, the present disclosure addresses the disadvantages associated with known hair clips. In particular, the hair clip apparatus provides a multi-mode attachment mechanism which includes a clasp for securing the hair in a desired style and additional hair retention structure which retains the hair clip apparatus relative to the volume of hair adjacent the clasp. In accordance with one exemplary embodiment, a hair clip apparatus includes a base, a tongue extending from the base and defining a longitudinal axis, a clasp extending longitudinally from the base, and configured for movement relative to the base between a closed condition adjacent the tongue and an open condition at least partially spaced from the tongue to permit entry of hair between the clasp and the tongue, and a plurality of hair engaging teeth extending longitudinally from the base and being spaced from the tongue. The clasp is normally biased toward the closed condition to trap the hair disposed between the clasp and the tongue. The hair engaging teeth are configured to engage a neighboring volume of hair to resist removal of the clasp and the tongue relative to the hair trapped therebetween.

Adjacent hair engaging teeth of the plurality of hair engaging teeth are laterally spaced with respect to each other, and configured to retain hair therebetween. The hair engaging teeth each may include an enlarged midsegment relative to segments of each hair engaging teeth adjacent the enlarged midsegment. The enlarged midsegment of adjacent hair engaging teeth cooperate to facilitate retention of hair within the hair engaging teeth. In addition, or supplemental therewith, the hair engaging teeth and at least one of the base or the tongue are configured to trap hair therebetween to further facilitate retention within the hair. In one embodiment, the hair engaging teeth and the tongue are disposed in general parallel relation to facilitate entry of hair therebetween. The hair engaging teeth may be substantially linear.

In one embodiment, the tongue and the clasp define a substantially concave profile when the clasp is in the closed condition.

The clasp may define a substantially convex profile when the clasp is in the open condition. In addition, the tongue may be substantially linear in general parallel relation with the hair engaging teeth when the clasp is in the open condition. In a certain embodiment, the clasp includes a pair of legs, which are coupled at first longitudinal ends thereof to the base in spaced relation and coupled to each other at second longitudinal ends thereof. The clasp may be configured to articulate relative to the base to transition between the closed condition and the open condition thereof.

The hair clip apparatus of the present disclosure incorporates a clasp which cooperates with the tongue to retain the hair in a desired styling effect. In addition, the hair clip apparatus includes a plurality of hair engaging teeth spaced from the clasp and the tongue to engage hair surrounding the clasp and the tongue. Thus, the hair clip apparatus is retained in the volume of hair by trapping the hair between the clasp and the tongue, and also via the hair engaging teeth. The hair engaging teeth also are arranged to retain and secure hair between adjacent teeth, and also trap hair between the inner surfaces of the teeth and the base and/or tongue.

Other features of the present disclosure will be appreciated from the following description of same.

BRIEF DESCRIPTION OF THE DRAWINGS

Various embodiments of the present disclosure are described hereinbelow with references to the drawings, wherein.

DETAILED DESCRIPTION

Figure 1:
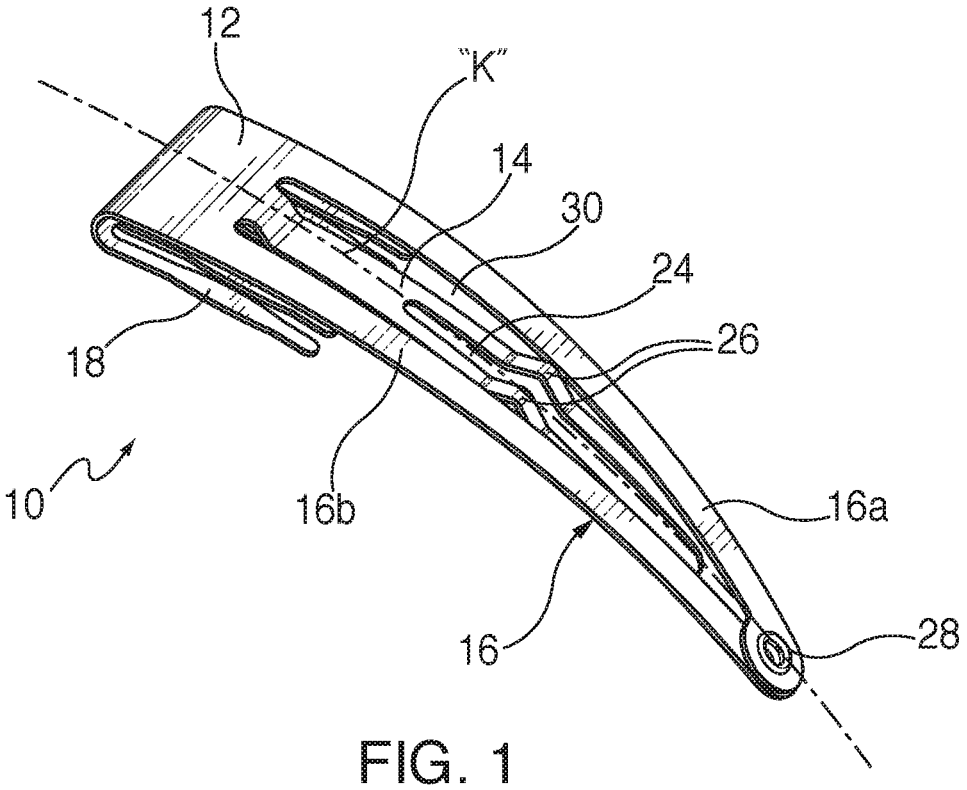
FIGS. 1-2 are first and second perspective views of the hair clip apparatus in accordance with the principles of the present disclosure illustrating the clasp, the tongue and the hair engaging teeth with the clasp depicted in the closed condition thereof.
Figure 2:
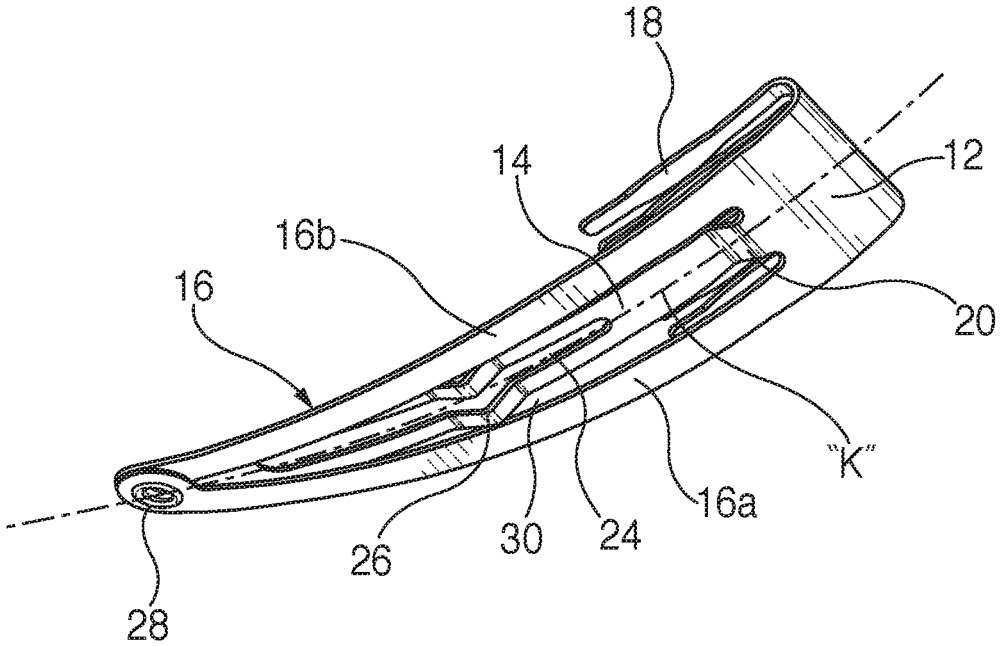
Figure 3:
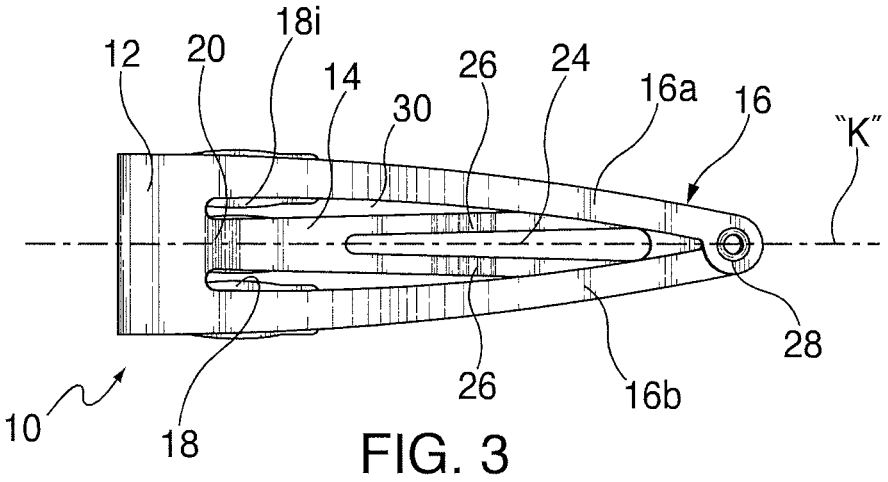
FIG. 3 is a top plan view of the hair clip apparatus.

Referring now to the drawing figures wherein like reference numerals identify similar or like components throughout the several views, FIGS. 1-5 illustrate the hair clip apparatus in accordance with the principles of the present disclosure. The hair clip apparatus is contemplated for use to retain hair in a desired orientation, e.g., bunched together, away from the eyes, pulled back, or in a ponytail. The hair clip apparatus incorporates a multi-mode attachment mechanism which facilitates retention of the hair clip apparatus within the volume of hair while also retaining the desired style effect even during extreme physical activity of the user.

The hair clip apparatus 10 includes a base 12 from which depends a tongue 14 defining a longitudinal axis "k", a clasp 16 and a plurality of hair engaging teeth 18. The hair clip apparatus 10 may be monolithically formed as a single unit via a stamping, coining or molding process, and may be fabricated from a relatively resilient material including spring steel, aluminum, or a suitable polymeric material. Other materials are also contemplated.

The base 12 is generally U-shaped and supports the remaining components, i.e., the tongue 14, the clasp 16 and the hair engaging teeth 18, of the hair clip apparatus 10. The tongue 14 includes an offset segment 20 which is connected to the base to define a lateral gap 22 when viewed in side elevation (FIG. 5) for reception of hair between the tongue 14 and the clasp 16. The offset segment 20 may also assist in retaining hair between the tongue 14 and the hair engaging teeth 18. The tongue 14 may define a longitudinal slot 24 to increase its flexibility or, alternatively, may be devoid of the longitudinal slot 24. The tongue 14 may define V-shaped raised segments or projections 26, e.g., at along the mid-section of the tongue, which facilitate engagement of the hair relative to the tongue 14 and the clasp 16.

The clasp 16 includes a pair of laterally spaced clasp legs 16*a*, 16*b* which are coupled to the base 12 at one longitudinal end and coupled to each other via fastener 28 at a second longitudinal end longitudinally spaced from the base 12. Any fastener for coupling the clasp legs to each other are envisioned including rivets, screws, pins or the like. In the alternative, the clasp 16 may be manufactured whereby the clasp legs 16*a*, 16*b* are integrally or monolithically formed at the second longitudinal end thereby obviating the requirement for a fastener. The clasp legs 16*a*, 16*b* define a longitudinal opening 30 through the clasp 16 which increases its overall flexibility. The longitudinal opening 30 may at least partially receive the V-shaped raised projections 26 of the tongue 14.

Figure 4:
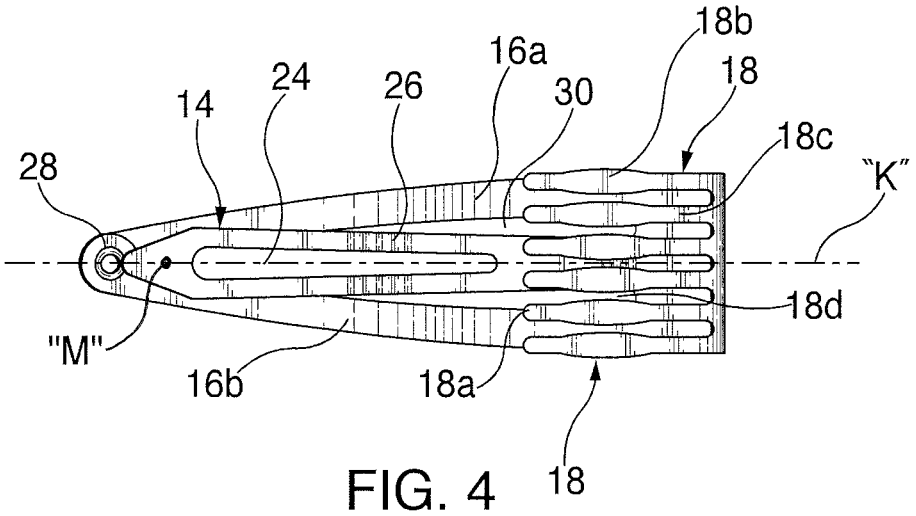
FIG. 4 is a bottom plan view of the hair clip apparatus.
Figure 5:
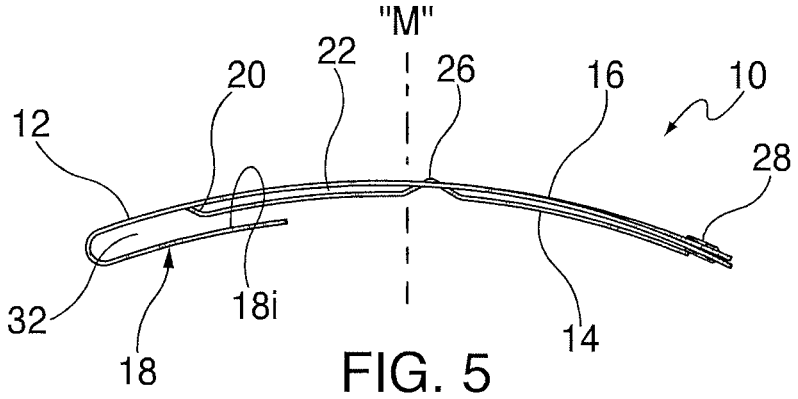
FIG. 5 is a side elevation view of the hair clip apparatus.

As best depicted in FIGS. 4 and 5, the hair engaging teeth 18 extend longitudinally relative to the longitudinal axis "k", and are radially or vertically spaced along a vertical axis "m" orthogonal to the longitudinal axis "k" to be spaced from the tongue 14 and the clasp 16 (FIG. 5) to define a hair receiving gap 32. At least three or more hair engaging teeth 18 are envisioned. In one exemplary embodiment, six longitudinal teeth are provided. Adjacent hair engaging teeth 18 are radially or laterally spaced relative to each other. Each hair engaging tooth 18 includes a narrow entry end segment 18*a*, an enlarged mid-segment 18*b* and a narrow remote end segment 18*c* adjacent the base 12. This configuration enhances retention of the hair engaging teeth 18 within the volume of hair by, e.g., defining a narrow-slotted segment 18*d* between the mid-segments 18*b* of adjacent hair engaging teeth 18, which slotted segments 18*d* resist passage of hair strands therethrough once the hair engaging teeth 18 have been lodged into the volume of hair. The hair engaging teeth 18 further define inner surfaces 18*i* (FIGS. 3 and 5) which are configured to trap and secure hair extending disposed within the gap 32 defined between the hair engaging teeth 18 and the base 12 and/or tongue 14. The hair engaging teeth 18 are substantially linear.

FIGS. 1-5 depict the clasp 16 in a closed condition. In the closed condition of the clasp 16, the clasp 16 defines an arcuate profile, e.g., a concave profile, having a radius of curvature, extending along at least a majority of its length. The hair engaging teeth 18 are substantially linear in the closed condition of the clasp. In the alternative, the hair engaging teeth may have a slight curvature corresponding to the curvature of the clasp 16. In addition, the tongue 14 also may be curved to generally follow the curvature of the clasp 16 and/or the hair engaging teeth 18.

Figure 6:
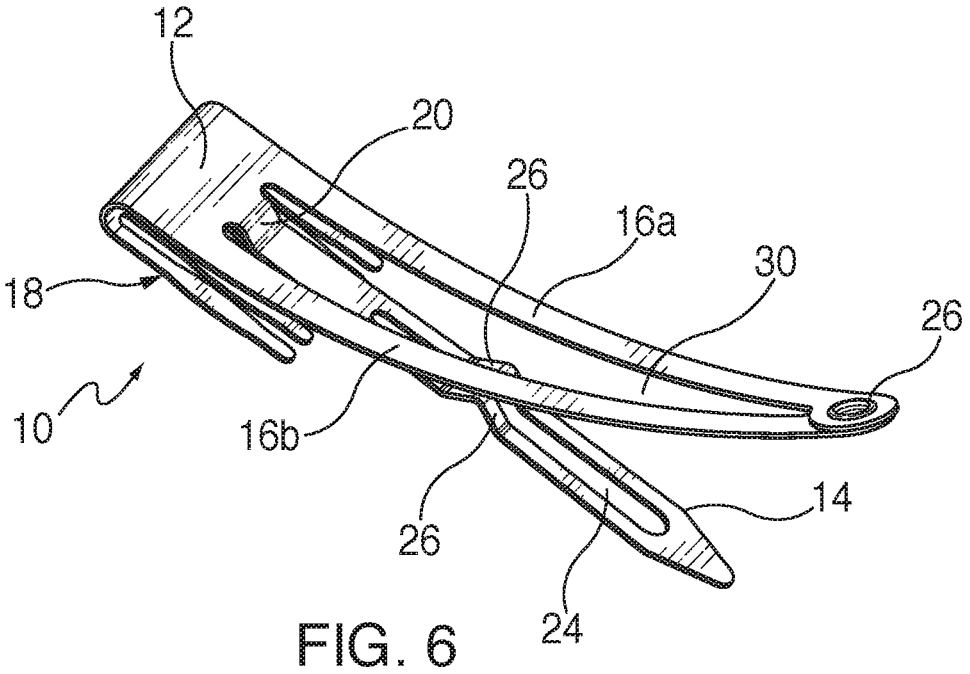
FIGS. 6-7 are perspective views of the hair clip apparatus similar to the views of FIGS. 1-2 illustrating the clasp in the open condition thereof.
Figure 7:
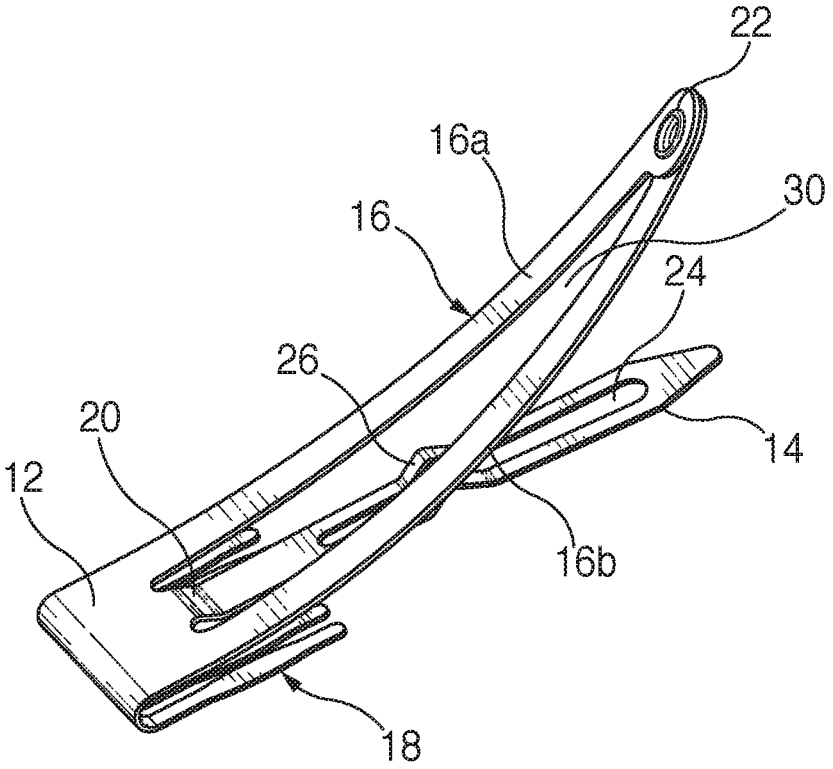
Figure 8:
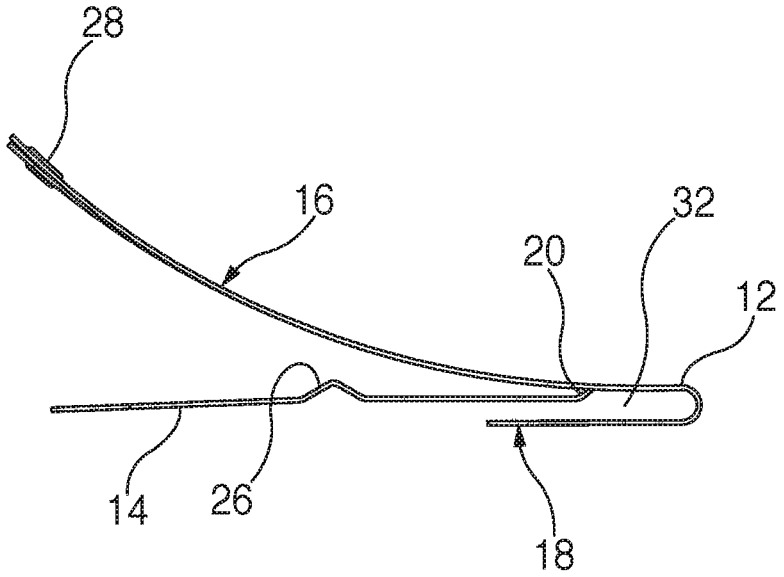
FIG. 8 is a side elevation view of the hair clip apparatus illustrating the clasp in the open condition.

FIGS. 6-8 illustrate the clasp 16 in the open condition. The clasp 16 may be moved to the open condition through manual manipulation, by, e.g., pulling on the second longitudinal end of the clasp 16 adjacent the fastener 28 whereby the clasp 16 articulates or pivots relative to the base 12 along, e.g., a living hinge or the like. In the open condition of the clasp 16, the clasp 16 may define a substantially convex configuration spaced from the tongue 14 to permit reception of hair between the clasp 16 and the tongue 14. Furthermore, movement of the clasp 16 to the open condition similarly transitions the tongue 14 to assume a general linear orientation complementing the linear orientation of the hair engaging teeth 18. In one embodiment, the hair engaging teeth 18 and the tongue 14 are generally parallel to each other. The parallel arrangement enhances passage of hair between the hair engaging teeth 18 and the tongue 14 during placement of the hair clip apparatus 10 within the volume of hair by providing a linear path through which the hair may enter within the gap 32 defined between the hair engaging teeth 18 and the base 12 and/or tongue 14.

It is envisioned that the hair clip apparatus 10 may be fabricated such that the clasp 16 will invert to its open condition during manipulation of the clasp 16 beyond, e.g., a linear orientation, i.e., the clasp 16 will spring open to the open condition and remain in the open condition until the clasp 16 is subjected to a return force. Similarly, the clasp 16 may spring back to its closed condition upon return movement thereof beyond a linear configuration. The tongue 14 may transition in a similar manner the clasp 16.

The use of the hair clip apparatus 10 in retaining hair in a defined style will be discussed. When a section of hair is manipulated to the desired styling effect, the clasp 16 of the hair clip apparatus 10 is transitioned to the open condition of FIGS. 6-8. In the open condition, the clasp 16 is spaced from the tongue 14 for reception of hair therebetween and the hair engaging teeth 18 and the tongue 14 are spaced from each other, e.g., parallel to each other, in position for advancement within the adjacent volume of hair. The user then transitions the clasp 16 to the closed condition whereby the hair is engaged and secured in the desired styling effect between the clasp 16 and the tongue 14. The V-shaped projections 26 of the tongue 14 assist in engaging the hair and retaining the hair relative to the longitudinal opening 30 of the clasp 16. Simultaneously therewith, prior to, or subsequent thereto, the entire clip apparatus 10 is advanced into the volume of hair whereby the hair engaging teeth 18 pass through and become lodged in the neighboring volume of hair surrounding, or adjacent, to the styled hair retained between the clasp 16 and the tongue 14. The parallel arrangement of the hair engaging teeth 18 and the tongue 14 facilitates entry of the neighboring volume of hair within the gap 32 between the base 12 and/or tongue 14 and the hair engaging teeth 18. As discussed hereinabove, the configuration of the hair engaging teeth 18, e.g., the narrow slot segments 18*d* between the enlarged midsegments 18*b* of adjacent hair engaging teeth 18, trap the hair proximate the base 12 thereby resisting movement of the entire hair clip apparatus 10 relative to the volume of hair. The neighboring volume of hair penetrated by the hair engaging teeth 18 are thus trapped between the hair engaging teeth 18 themselves, and also between the internal surfaces 18*i* of the hair engaging teeth 18 and the base 12 or the tongue 14 providing a multiple structural framework which retains the hair clip apparatus 10 within the volume of hair. The offset segment 20 of the tongue 14 also may assist in retaining hair adjacent the base 12 and within the gap 32.

The hair clip apparatus of the present disclosure is capable of securing hair in a desired style while also incorporating structure which fixes and retains the hair clip apparatus within the volume of hair neighboring the styled hair. Specifically, the tongue 14, the clasp 16 and the hair engaging teeth 18 cooperate to maintain the desired hair style and effectively secure the apparatus within the hair even during physical activity and other movement of the user.

Although the illustrative embodiments of the present disclosure have been described herein with reference to the accompanying drawings, the above description, disclosure, and figures should not be construed as limiting, but merely as exemplifications of particular embodiments. It is to be understood, therefore, that the disclosure is not limited to those precise embodiments, and that various other changes and modifications may be effected therein by one skilled in the art without departing from the scope or spirit of the disclosure.

What is claimed is:

1. A hair clip apparatus, comprising:

a base;

a tongue extending from the base and defining a longitudinal axis;

a clasp extending longitudinally from the base, the clasp configured for movement relative to the base between a closed condition adjacent the tongue and an open condition at least partially spaced from the tongue to permit entry of hair between the clasp and the tongue, the clasp being normally biased toward the closed condition to trap the hair disposed between the clasp and the tongue; and a plurality of hair engaging teeth extending longitudinally from the base and distinct from the tongue, the hair engaging teeth being spaced from the tongue along a vertical axis orthogonal to the longitudinal axis, the hair engaging teeth configured to engage a neighboring volume of hair to resist removal of the clasp and the tongue relative to the hair trapped therebetween;

wherein the hair engaging teeth define a longitudinal length less than respective longitudinal lengths defined by the tongue and the clasp.

2. The hair clip apparatus according to claim 1 wherein adjacent hair engaging teeth are laterally spaced with respect to each other, and configured to retain hair therebetween.

3. The hair clip apparatus according to claim 2 wherein the hair engaging teeth each include an enlarged midsegment relative to segments of each hair engaging teeth adjacent the enlarged midsegment, the enlarged midsegment of adjacent hair engaging teeth cooperating to facilitate retention of hair within the hair engaging teeth.

4. The hair clip apparatus according to claim 2 wherein the hair engaging teeth and at least one of the base or the tongue are configured to trap hair therebetween to facilitate retention within the hair.

5. The hair clip apparatus according to claim 4 wherein the hair engaging teeth and the tongue are disposed in general parallel relation to facilitate entry of hair therebetween.

6. The hair clip apparatus according to claim 1 wherein the tongue and the clasp each define a substantially concave profile when the clasp is in the closed condition.

7. The hair clip apparatus according to claim 1 wherein the hair engaging teeth are substantially linear.

8. The hair clip apparatus according to claim 7 wherein the tongue is substantially linear and in general parallel relation with the hair engaging teeth when the clasp is in the open condition.

9. The hair clip apparatus according to claim 1 wherein the clasp defines a substantially convex profile when the clasp is in the open condition.

10. The hair clip apparatus according to claim 1 wherein the clasp includes a pair of legs, the legs coupled at first longitudinal ends thereof to the base in spaced relation and coupled to each other at second longitudinal ends thereof.

11. The hair clip apparatus according to claim 1 wherein the clasp is configured to articulate relative to the base to transition between the closed condition and the open condition thereof.

12. The hair clip apparatus according to claim 1 wherein the longitudinal length of the hair engaging teeth is less than one-half the respective lengths of at least one of the tongue and the clasp.

13. The hair clip apparatus according to claim 12 wherein the longitudinal length of the hair engaging teeth is less than one-half the respective lengths of each of the tongue and the clasp.

14. The hair clip apparatus according to claim 1 wherein the tongue defines a longitudinal slot relative to the longitudinal axis.

15. The hair clip apparatus according to claim 1 wherein at least portions of the clasp are spaced from the tongue when the clasp is in the closed condition.

* * * * *